US007204495B2

(12) United States Patent
Reuss et al.

(10) Patent No.: US 7,204,495 B2
(45) Date of Patent: Apr. 17, 2007

(54) HIGHBACK FORMED OF MULTIPLE MATERIALS

(75) Inventors: Stefan Reuss, Rum (AT); David J. Dodge, Williston, VT (US); Ryan Coulter, Stowe, VT (US); Markus Koller, Innsbruck (AT); James D. Laughlin, Burlington, VT (US); Brian West, Burlington, VT (US)

(73) Assignee: The Burton Corporation, Burlington, VT (US)

( * ) Notice: Subject to any disclaimer, the term of this patent is extended or adjusted under 35 U.S.C. 154(b) by 91 days.

(21) Appl. No.: 10/406,873

(22) Filed: Apr. 4, 2003

(65) Prior Publication Data

US 2003/0193151 A1 Oct. 16, 2003

Related U.S. Application Data

(63) Continuation of application No. 09/677,910, filed on Oct. 3, 2000, now Pat. No. 6,543,793, which is a continuation of application No. 09/478,776, filed on Jan. 6, 2000, now abandoned.

(51) Int. Cl.
*A63C 9/00* (2006.01)

(52) U.S. Cl. ..... 280/11.36

(58) Field of Classification Search ..... 280/11.36, 280/14.21, 14.24, 619, 620, 623, 624, 633, 280/634, 842; 36/89, 69, 117.1
See application file for complete search history.

(56) References Cited

U.S. PATENT DOCUMENTS 2,211,822 A * 8/1940 Jennings ..... 36/71
3,713,231 A 1/1973 Mochizuki
3,807,062 A 4/1974 Spier
3,945,135 A 3/1976 Hanson et al.
4,060,256 A 11/1977 Collombin et al.
4,154,009 A 5/1979 Kubelka et al.
4,203,235 A 5/1980 Van Pelt, Jr.

(Continued)

FOREIGN PATENT DOCUMENTS

CA 2071705 12/1993

(Continued)

OTHER PUBLICATIONS

Northwave Snowboard Boots/Drake Performance Advantage Bindings, 2000/2001 catalog, pp. 22-26.

(Continued)

*Primary Examiner*—Frank Vanaman
(74) *Attorney, Agent, or Firm*—Wolf, Greenfield & Sacks, P.C

(57) ABSTRACT

A highback for controlling a gliding board, such as a snowboard, through leg movement of a rider. The highback is comprised of at least two distinct materials with different stiffnesses to achieve a desired blend of stiffness and flexibility. The highback may employ a material of greater stiffness in one or more regions to provide high force transmission between the rider and the board. The highback may employ a material of lesser stiffness in one or more regions where flexibility is desired for more gradual power transmission, comfort and/or to facilitate highback adjustability. The arrangement of the different materials provides a lightweight highback with a relatively sleek profile having selected regions of stiffness and/or flexibility.

56 Claims, 5 Drawing Sheets

U.S. PATENT DOCUMENTS

| | | | | | |
|---|---|---|---|---|---|
| 4,280,286 | A | | 7/1981 | Sartor | |
| 4,281,468 | A | | 8/1981 | Giese et al. | |
| 4,473,235 | A | * | 9/1984 | Burt | 280/11.36 |
| 4,551,933 | A | | 11/1985 | Morell et al. | |
| 4,724,625 | A | | 2/1988 | Sartor | |
| 4,759,137 | A | | 7/1988 | Lederer | |
| 4,864,743 | A | | 9/1989 | Begey et al. | |
| 4,907,354 | A | | 3/1990 | Benoit et al. | |
| 4,979,760 | A | | 12/1990 | Derrah | |
| 5,003,710 | A | | 4/1991 | Pozzobon | |
| 5,107,609 | A | | 4/1992 | Sartor | |
| 5,174,051 | A | | 12/1992 | Walkhoff et al. | |
| 5,234,230 | A | | 8/1993 | Crane et al. | |
| 5,243,774 | A | | 9/1993 | Mattiuzzo | |
| 5,261,689 | A | | 11/1993 | Carpenter et al. | |
| 5,295,316 | A | | 3/1994 | Bergamin | |
| 5,575,091 | A | | 11/1996 | Mattiuzzo | |
| 5,606,808 | A | | 3/1997 | Gilliard et al. | |
| 5,647,148 | A | | 7/1997 | Meiselman | |
| 5,664,344 | A | | 9/1997 | Marmonier | |
| 5,690,350 | A | | 11/1997 | Turner et al. | |
| 5,690,351 | A | | 11/1997 | Karol | |
| 5,692,765 | A | | 12/1997 | Laughlin | |
| 5,713,587 | A | | 2/1998 | Morrow et al. | |
| 5,727,797 | A | | 3/1998 | Bowles | |
| 5,761,835 | A | | 6/1998 | Okajima | |
| 5,765,853 | A | | 6/1998 | Erb | |
| 5,802,741 | A | | 9/1998 | Turner et al. | |
| 5,815,952 | A | * | 10/1998 | Bobrowicz | 36/117.3 |
| 5,819,440 | A | | 10/1998 | Okajima | |
| 5,819,441 | A | * | 10/1998 | Perrissoud | 36/118.2 |
| 5,832,635 | A | | 11/1998 | Finney et al. | |
| 5,875,570 | A | | 3/1999 | Sartor | |
| 5,894,684 | A | | 4/1999 | Sand et al. | |
| 5,901,469 | A | | 5/1999 | Saillet | |
| 5,906,058 | A | | 5/1999 | Rench et al. | |
| 5,909,886 | A | | 6/1999 | Tugutaka et al. | |
| 5,915,720 | A | | 6/1999 | Turner et al. | |
| 5,926,979 | A | | 7/1999 | Borel | |
| 5,941,554 | A | | 8/1999 | Bourdeau | |
| 5,966,843 | A | | 10/1999 | Sand et al. | |
| 5,967,531 | A | | 10/1999 | Saillet | |
| 6,027,136 | A | | 2/2000 | Phillips | |
| 6,099,018 | A | | 8/2000 | Maravetz et al. | |
| 6,102,429 | A | | 8/2000 | Laughlin et al. | |
| 6,116,635 | A | | 9/2000 | Rigal | |
| 6,123,342 | A | | 9/2000 | Grell | |
| 6,206,403 | B1 | | 3/2001 | Black et al. | |
| 6,231,057 | B1 | * | 5/2001 | Reuss et al. | 280/14.21 |
| 6,231,066 | B1 | | 5/2001 | Okajima | |
| 6,273,450 | B1 | | 8/2001 | Challande et al. | |
| 6,360,454 | B1 | | 3/2002 | Dachgruber et al. | |
| 6,557,865 | B1 | * | 5/2003 | Reuss et al. | 280/14.21 |
| 6,631,919 | B1 | * | 10/2003 | West et al. | 280/633 |

FOREIGN PATENT DOCUMENTS

| | | | |
|---|---|---|---|
| DE | 2 128769 | | 6/1971 |
| DE | 27 46 980 | | 4/1979 |
| DE | 198 02 304 | | 7/1999 |
| EP | 0 646 334 | A1 | 9/1994 |
| EP | 0 838 248 | A1 | 4/1998 |
| EP | 0 933 100 | A1 | 8/1999 |
| FR | 2807331 | * | 10/2003 |
| JP | 0910830 | | 4/1997 |
| WO | WO 85/04557 | | 10/1985 |
| WO | WO 93/14835 | | 8/1993 |
| WO | WO 94/07386 | | 4/1994 |
| WO | WO 00/21618 | A2 | 4/2000 |

OTHER PUBLICATIONS

Photographs of a Drake Highback, 3 sheets.
Photograph of a Flite Snowboard Binding (labeled as photograph A), 1 sheet.
Photograph of a Sims Snowboard Binding (labeled as photograph B), 1 sheet.
European Search Report for Application No. EP 03 01 8634, dated Oct. 23, 2003, 2 pages.

* cited by examiner

HIGHBACK FORMED OF MULTIPLE MATERIALS

RELATED APPLICATIONS

This application is a continuation of U.S. patent application Ser. No. 09/677,910, filed on Oct. 3, 2000, now U.S. Pat. No. 6,543,793, which is a continuation of U.S. patent application Ser. No. 09/478,776, filed on Jan. 6, 2000, now abandoned.

BACKGROUND OF THE INVENTION

1. Field of the Invention

The present invention relates generally to a highback for gliding sports, such as snowboarding, and, more particularly, to a highback formed of multiple materials having different stiffness.

2. Description of the Related Art

Snowboard binding systems for soft snowboard boots typically include an upright member, called a "highback" (also known as a "lowback" and a "skyback"), that is contacted by the rear portion of a rider's leg. The highback, which may be mounted to a binding or a boot, acts as a lever that helps transmit forces directly to and from the board, allowing the rider to efficiently control the board through leg movement. For example, flexing one's legs rearward against the highback places the board on its heel edge with a corresponding shift in weight and balance acting through the highback to complete a heelside turn.

Force transmission and, consequently, board control can be varied by highback stiffness. As the stiffness of the highback increases or decreases, force transmission increases or decreases, respectively, resulting in more or less responsive board control. A stiff highback may create undesirable pressure points against a rider's leg, rather than apply a uniform pressure distribution across the boot and leg. For example, the upper portion of a stiff highback may engage the rider's calf muscle, thereby concentrating much of the force between the highback and the rider's leg onto the calf muscle, a condition riders generally find uncomfortable.

Snowboard bindings typically are mounted to a snowboard to allow the rider to select a desired stance angle of the binding relative to the board. Specifically, the angle between the midline of the binding and the midline of the snowboard can be altered for different riding styles, such as trick riding, backcountry riding or simple traveling, and for different riding preferences. Once the desired stance angle is set, a rider may wish to reposition the highback, whether mounted to a binding or to a boot, so that the highback is generally aligned with the heel-edge of the board to enhance force transmission during a heel-side turn. This may be accomplished by mounting the highback for lateral rotation about a substantially vertical axis. A stiff highback generally is more limited, as compared to a more flexible highback, in terms of the extent and the ease by which it can be laterally rotated to a desired position.

Known highbacks are typically molded from either a composite material or a plastic material. A highback formed from a composite material, while sleek and lightweight, is generally very stiff. In contrast, a highback formed from a more flexible plastic material generally is bulky and relatively heavy due to structural features typically molded into the highback that provide the necessary stiffness for force transmission.

It is an object of the present invention to provide an improved highback having a blend of stiffness and flexibility.

SUMMARY OF THE INVENTION

In one illustrative embodiment of the invention, a highback is provided for use with a component, such as a gliding board binding, a boot or a binding interface, that interfaces with a rider's leg and is supportable by a gliding board. The highback comprises an upright support member constructed and arranged to be contacted by and to support a rear portion of the rider's leg, and a pair of mounting locations integrally formed with the support member and being disposed on opposing sides of the lower portion thereof for mounting the highback to the gliding board component. The support member includes a lower portion and an upper portion, the support member being comprised of at least a first material having a first stiffness extending continuously from an upper end of the upper portion to at least a lower end of the upper portion. The mounting locations are comprised of a second material that is different from the first material and has a second stiffness that is different from the first stiffness.

In another illustrative embodiment of the invention, the highback comprises an upright support member including an upper portion and a heel cup integrally formed with the upper portion. The upper portion is constructed and arranged to be contacted by and to support a rear portion of the rider's leg. The heel cup is configured to hold a heel portion of a boot. The upper portion is comprised of a first material and the heel cup is comprised substantially of a second material that is different from the first material. The first material has a first stiffness and the second material has a second stiffness that is less than the first stiffness.

In a further illustrative embodiment of the invention, a snowboard binding is provided for securing a snowboard boot to a snowboard. The snowboard binding comprises a baseplate that is mountable to the snowboard, a heel hoop disposed at a heel end of the baseplate and a highback pivotally supported by the baseplate adjacent the heel hoop. The highback is constructed and arranged to be contacted by and to support a rear portion of a rider's leg. The highback includes an upper region that cooperates with the heel hoop to transmit forces between the rider's leg and the snowboard, and a lower region integrally formed with the upper region and pivotally mounted to the baseplate. The upper region is comprised of a first material and the lower region is comprised of a second material that is different from the first material. The first material has a first stiffness and the second material has a second stiffness that is less than the first stiffness.

Various embodiments of the present invention provide certain advantages. Not all embodiments of the invention share the same advantages and those that do may not share them under all circumstances. This being said, the present invention provides numerous advantages including the noted advantage of providing an improved highback.

BRIEF DESCRIPTION OF THE DRAWINGS

The invention will be appreciated more fully with reference to the following detailed description of illustrative embodiments thereof, when taken in conjunction with the accompanying drawings, wherein like reference characters denote like features, in which.

DETAILED DESCRIPTION

Figure 1:
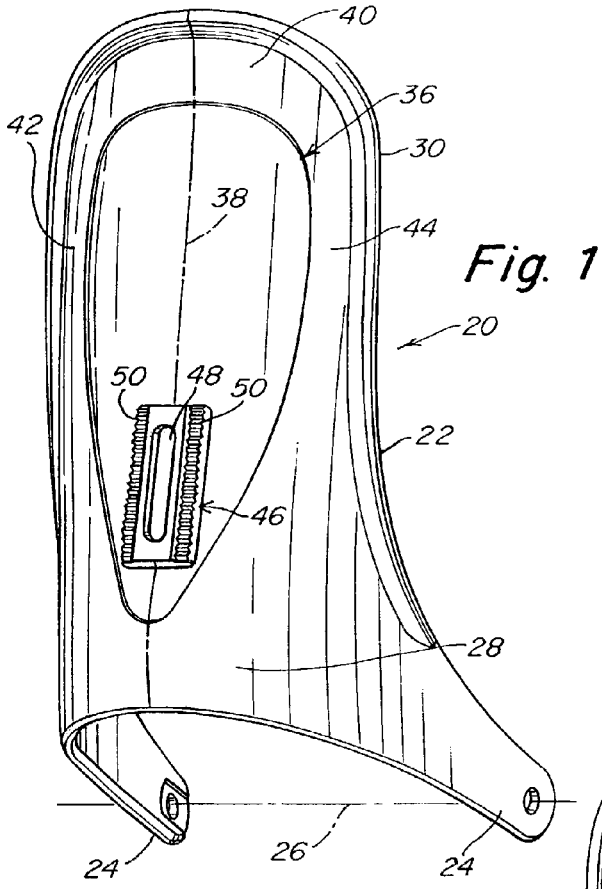
FIG. 1 is a rear perspective view of the highback according to one illustrative embodiment of the invention.
Figure 2:
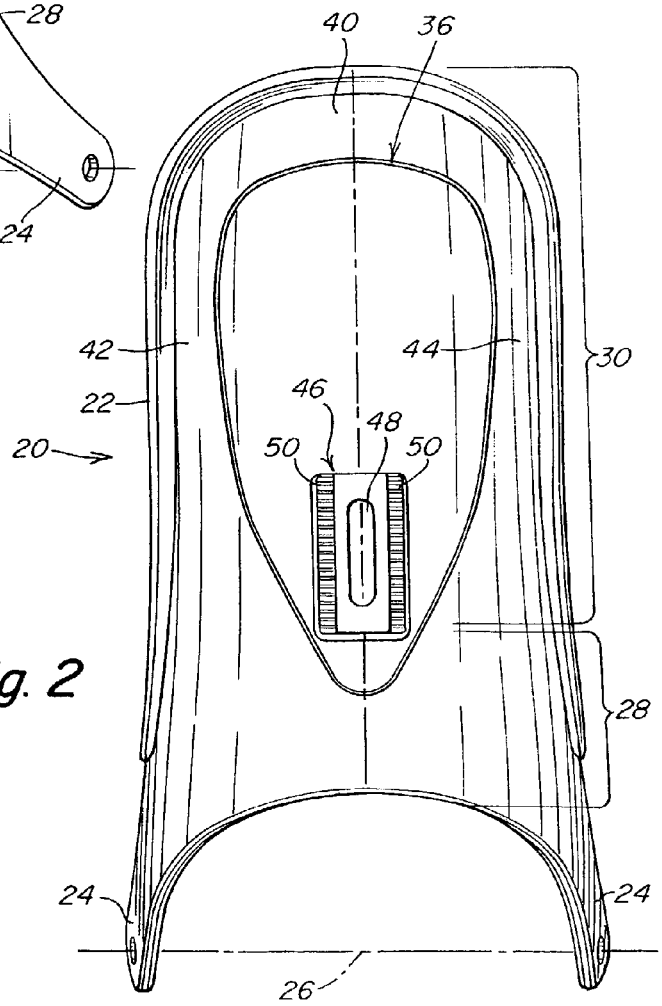
FIG. 2 is a rear view of the highback of FIG. 1.
Figure 3:
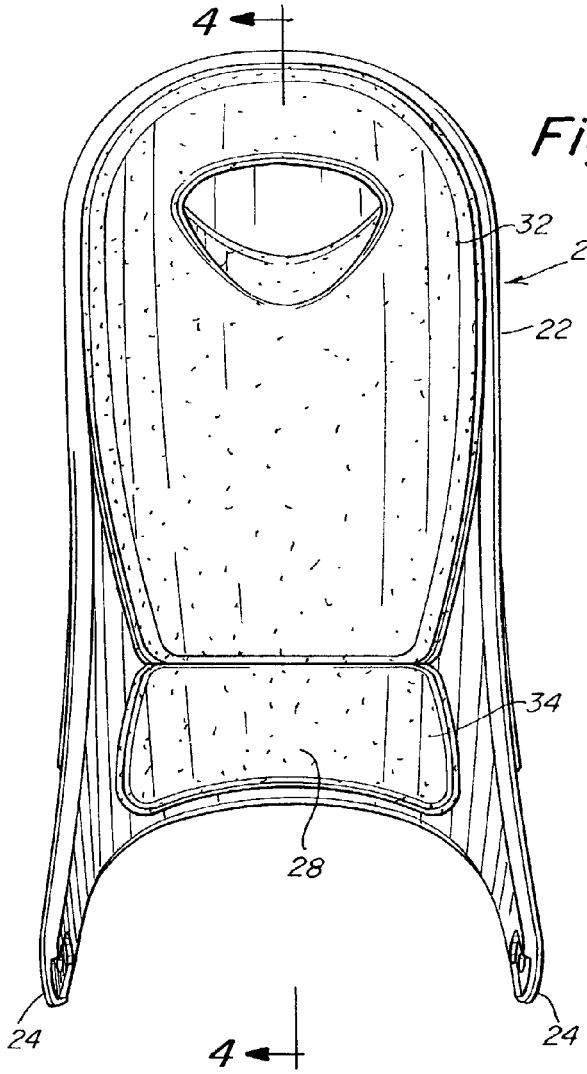
FIG. 3 is a front view of the highback of FIG. 1.
Figure 4:
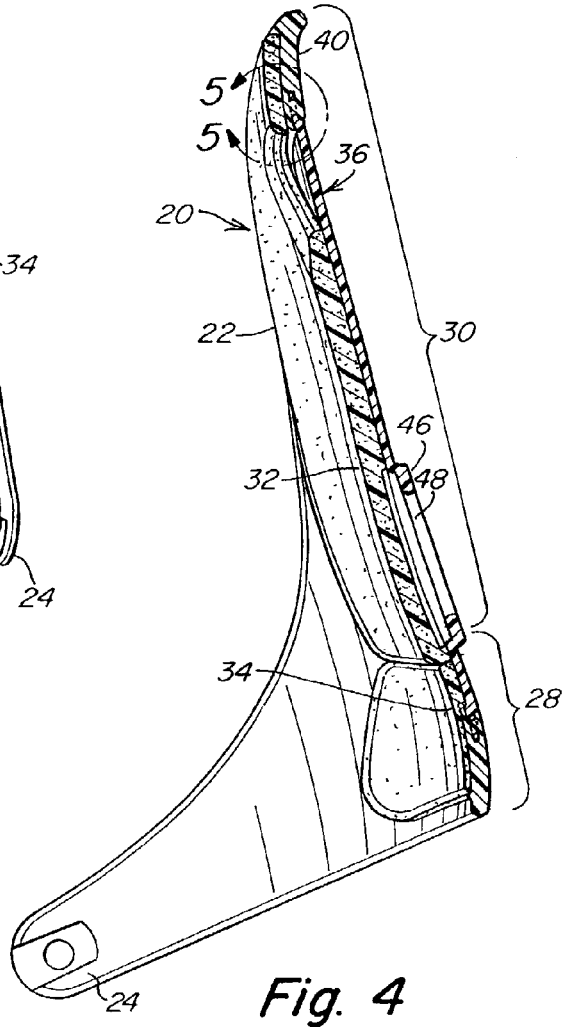
FIG. 4 is a cross-sectional view taken along section line 4—4 of FIG. 3.
Figure 5:
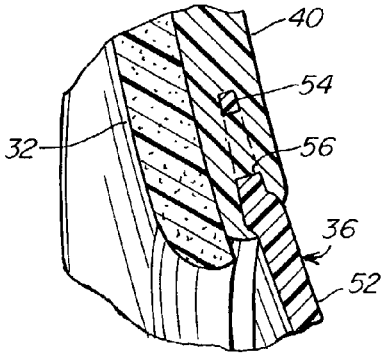
FIG. 5 is an enlarged fragmented view of a portion of FIG. 4 illustrating one embodiment of the connection between the cassette and the support member of the highback.

The present invention is directed to a highback, for use with a gliding board component, comprised of at least two distinct materials with different stiffnesses to achieve a desired blend of stiffness and flexibility. The highback may employ a material of greater stiffness in one or more regions to provide high force transmission between the rider and the board. The highback may employ a material of lesser stiffness in one or more regions where flexibility is desired for more gradual power transmission, comfort and/or to facilitate highback adjustability. The arrangement of the different materials provides a lightweight highback with a relatively sleek profile having selected regions of stiffness and/or flexibility.

The highback may be formed with a first material of relatively high stiffness extending along its vertical spine to provide a rigid region for transmitting forces between the rider and the board. The highback may also include one or more other materials of lesser stiffness in selected regions about the first material to reduce pressure points between the highback and the leg, particularly the rider's calf muscle, for increased comfort while maintaining heelside support for board control. A less stiff material may also be provided in selected regions of the highback for enhancing flexibility, such as may be desirable for lateral rotation of the highback and pivoting of the highback into a collapsed or storage configuration to provide a reduced profile, such as when the board is carried on a roof rack.

In one illustrative embodiment as shown in FIGS. 1–5, the highback 20 includes an upright support member 22 and a pair of lateral ears 24 disposed on opposing sides of the support member. The lateral ears 24 provide mounting locations that may be employed to pivotally attach the highback to a gliding board component, such as a snowboard binding, a snowboard boot or a binding interface, along a mounting axis 26 that is transverse to the length of the binding or boot. The lateral ears 24 may be configured to have any shape suitable with the particular mounting arrangement for the highback.

The support member 22 preferably has a contoured configuration that is compatible with the shape of a boot. The highback 20 includes a heel cup 28 in a lower portion of the support member 22 that is configured to grip and hold the heel portion of the boot. The support member 22 transitions from the heel cup 28 to an upper portion 30 of the highback that is configured to extend along and to be contacted by the rear portion of the rider's leg to provide heelside support for turning and controlling the board. The inner surface of the highback may include one or more resilient pads 32, 34 to increase heel hold, to absorb shock and to facilitate pressure distribution across the boot and leg.

In one illustrative embodiment of the invention, the highback 20 includes a first region 36 comprised of a first material extending along at least a portion of the spine 38 of the support member 22. The first material has a relatively high stiffness to provide the support member 22 with sufficient rigidity to transmit forces between the rider's leg and the board. The first material extends continuously from an upper end of the upper portion 30 to at least a lower end of the upper portion that will engage with the gliding board component. As illustrated, the first material may also extend into a portion of the heel cup 28 to create a beam effect along substantially the entire spine 38 of the support member.

While a high degree of rigidity may be desirable in the upper portion 30 of the support member to ensure force transmission, more flexibility is generally preferred in the lower regions of the highback, for example, to facilitate lateral rotation of the highback on the snowboard component for accommodating a particular binding stance angle. In the illustrative embodiment, the lateral ears 24 are comprised of a second material having a stiffness that is less than the stiffness of the first material. The flexibility through the lower portion of the highback is further enhanced with a substantial portion of the heel cup 28 also being comprised of the second material.

It is to be appreciated, however, that the heel cup 28 may be formed from one or more other materials having a stiffness that is different from both the first and second materials. For example, the heel cup 28 may be formed of a material having a stiffness that is less than the first material and either greater than or less than the second material.

The first region 36 is bordered by an upper margin 40 and opposing side margins 42, 44 that extend from the upper margin 40 to the heel cup 28. In the illustrative embodiment, the upper and side margins 40, 42, 44 are formed from the second material. Surrounding the first region 36 with a more flexible material is conducive to providing gradual force transmission between the rider and the board. A more flexible upper margin 40 also reduces a potential pressure point between the upper edge of the highback and the rider's leg.

It is to be appreciated that the more flexible second material may terminate prior to the upper and/or side margins 40, 42, 44. The highback 20 may even be configured without one or more of the upper and side margins 40, 42, 44 of the second material to achieve any desirable highback configuration. Further, one or more of the upper and side margins 40, 42, 44 may be formed from any suitable material or combination of materials having a particular stiffness, including the first and second materials or any other suitable material, as would be apparent to one of skill.

The first region 36 of material may be shaped in any suitable configuration for providing a desired overall stiffness along the support member. In the illustrative embodiment, the first region 36 is shaped with an inverted tear drop or oar blade configuration. This particular configuration provides the support member with a high degree of stiffness across the upper portion 30. The stiffness of the support member 22 gradually decreases in a direction toward the heel cup 28, where more flexibility is generally desired, as the width of the region 36 decreases. The particular shape of the region 36, however, is not limited to this configuration and other shapes are contemplated to achieve any desired localized stiffness or overall stiffness profile. For example, the first material may be provided in two or more distinct regions that extend along portions of the upper portion and are spaced across the width of the support member.

A snowboard rider's leg is generally held by the highback at a forward angle relative to the board for balance, control and to ensure the rider's knee is bent for better shock absorption, particularly when landing jumps. To hold the rider's leg in such a stance, the highback is typically inclined relative to the board in a position referred to as "forward lean". The highback may be mounted to the snowboard component for rotation in the heel-to-toe direction and, therefore, the rider may selectively adjust the forward lean angle of the highback relative to the board for comfort, control and the rider's particular riding style.

In one illustrative embodiment, the highback 20 includes a forward lean adjuster mount 46 that is configured to receive a suitable forward lean adjuster for setting the forward lean of the highback. The mount 46 is supported by the first region 36 of material to ensure direct transmission of force from the highback to the board. As shown, the mount 46 is integrally formed of the first material along the spine 38 of the support member 22 at the lower end of the upper portion 30 above the heel cup 28.

The forward lean adjuster mount 46 may be provided with an adjustment feature that is adapted to adjustably support a forward lean adjuster. In one embodiment, the mount 46 is provided with an elongated slot 48 along which the forward lean adjuster may positioned to set the forward lean of the highback. The mount 46, however, may be provided with any suitable structure or feature, such as a series of spaced holes, rather than or perhaps in conjunction with the slot to facilitate adjustment of the forward lean adjuster.

The forward lean adjuster mount 46 may also be provided with a plurality of locking elements 50 along the length of the mount to engage and maintain the forward lean adjuster in a desired forward lean position. In one embodiment, the locking elements 50 include a rack of teeth extending along each side of the slot 48. It is to be appreciated, however, that the locking elements 50 may include any suitable structure or feature, such as pins, holes and the like, for engaging with the forward lean adjuster.

Figure 6:
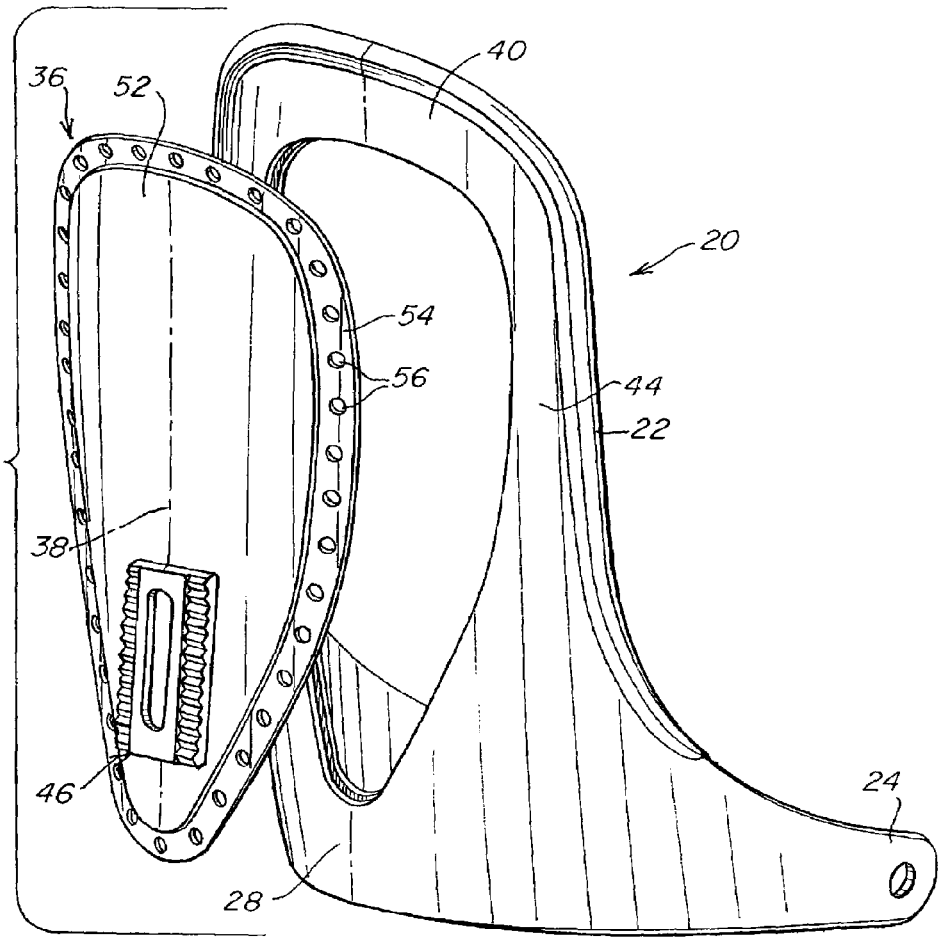
FIG. 6 is an exploded view of the highback of FIG. 1.

The highback 20 may be constructed using any suitable manufacturing techniques as would be apparent to one of skill in the art for combining two or more materials into a unitary structure. In one illustrative embodiment shown in FIGS. 6–7, the first region 36 is fabricated as a separate part, which may be referred to hereinafter as a cassette, that is joined to the support member 22 of the highback. The cassette 36 includes a body portion 52 and a peripheral flange 54 that extends from and circumscribes the body portion. The flange 54 is configured to connect the cassette 36 to the support member 22. As shown, the flange 54 may be provided with a plurality of holes 56 that facilitate the connection between the cassette and the support member.

Figure 7:
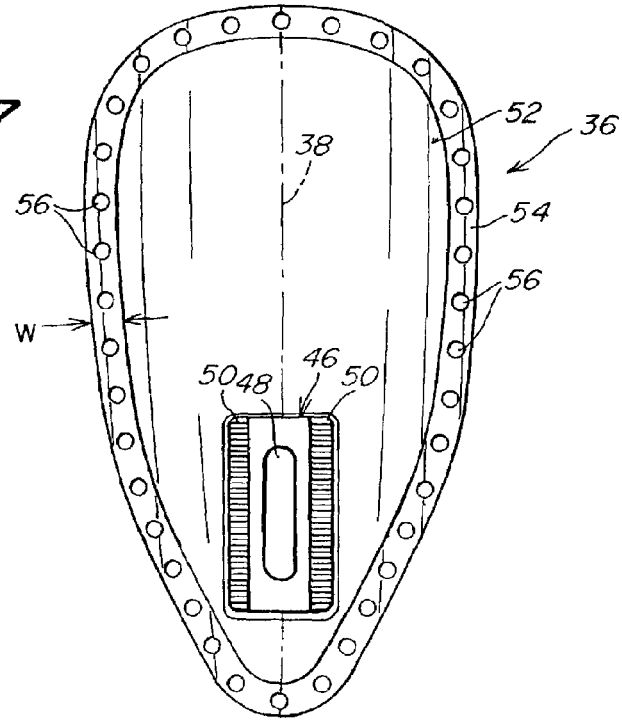
FIG. 7 is a rear view of one embodiment of the cassette employed with the highback of FIG. 1.

The cassette 36 may be over-molded with the second material to integrally form the overall highback structure. As shown in FIG. 7, the flange 54 of the cassette is encapsulated from both sides to capture the flange within the support member 22 and create a unitary structure capable of withstanding a wide range of forces applied to the highback. The flange 54 lies in a plane offset from the body portion 52 so that the rear surface of the cassette is generally flush with the rear surface of the support member. The plurality of holes 56 in the flange 54 are filled with the second material to create a positive mechanical joint between the cassette 36 and the support member 22 to reduce separation between the components. In one embodiment, the flange 54 has a width W of approximately 6 mm to establish the connection between the cassette and the support member.

It is to be appreciated that the cassette 36 may employ any suitable flange configuration apparent to one of skill. For example, the flange 54 may be formed with holes of various shapes, including circular, rectangular, oblong and the like. The flange 54 may be provided without holes and/or include teeth or other suitable features to enhance the connection between the cassette and the support member. The flange may also be formed by a plurality of individual extensions spaced about the periphery of the body portion 52.

The cassette 36 may be comprised of a lightweight, stiff composite material that provides the desired stiffness along the support member 22 without the bulk associated with less stiff plastic materials. In one embodiment, the cassette 36 is formed from a sheet of a thermoplastic composite including woven glass or carbon fabric layers combined with a nylon resin. The composite material is compression molded to form the desired configuration of the cassette, including one or more of the structural features described above or any other desired structure. One example of a suitable composite material includes TEPEX Flowcore available from Bond-Laminates of Trossingen, Germany. In one embodiment, the cassette 36 is compression molded from a sheet of material having a thickness of approximately 2 mm. Other suitable materials may include fiber-reinforced plastics, such as CELSTRAN and the like.

The remaining structure of the highback, including the lateral ears 24, heel cup 28 and the upper and side margins 40, 42, 44, may be formed of a less stiff, more flexible plastic material. In one embodiment, a nylon material is molded about the cassette 36, such as by injection molding. In addition to the mechanical connection formed between the cassette and the support member, the use of compatible materials, such as a nylon resin composite and a nylon over-mold material, may create a chemical bond between the materials to further unitize the overall structure of the highback. To enhance such a chemical bond between the materials, the over-molding process may be performed soon after the cassette has been compression molded and while it is still warm as would be apparent to one of skill.

Although the cassette 36 may be molded within the support member 22, it is to be appreciated that any suitable fastening scheme may be implemented to attach the cassette to the support member. For example, the cassette 36 may be attached to a preformed support member 22 using any suitable fasteners, such as screws, rivets and the like, as would be apparent to one of skill. Alternatively, or in conjunction with mechanical fasteners, the cassette may be bonded to the support member using a suitable adhesive.

It is to be appreciated that the highback 20 may be formed with any suitable combination of composite and plastic materials, including polyurethane, polyolefin and the like. It is also contemplated that the cassette 36 may be formed from a relatively stiff non-composite plastic material, such as a polyolefin, that is over-molded with a more flexible plastic, such as a polyurethane.

In another illustrative embodiment of the invention, the stiffness of the highback 20 may be adjusted using a plurality of interchangeable cassettes 36, each comprised of a material having a stiffness that differs from the other cassettes. The cassettes 36 may also be provided with different shapes to vary the overall stiffness of the cassettes as would be apparent to one of skill. The cassettes 36 may be removably attached to the support member, such as with removable fasteners, to allow easy replacement thereof.

The highback 20 according to the present invention may be employed in any gliding board activity, such as snowboarding, that would benefit from heelside support. For ease of understanding, however, and without limiting the scope of the invention, the inventive highback is now described below in connection with a snowboard binding.

Figure 8:
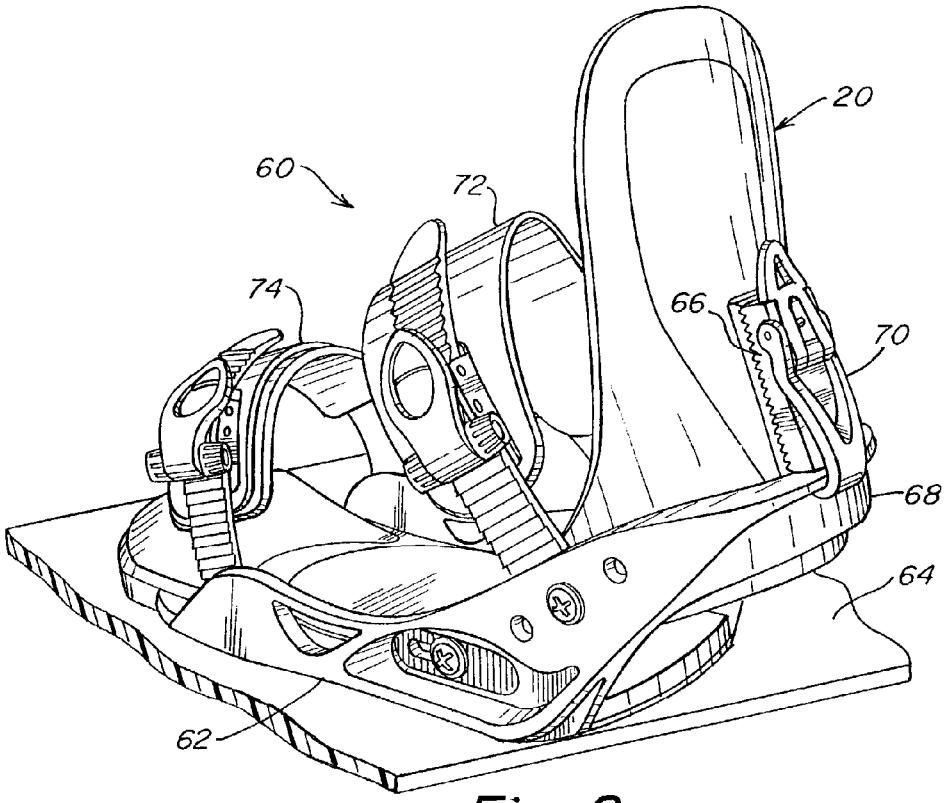
FIG. 8 is a side view of the highback incorporated with an illustrative embodiment of a snowboard binding according to another aspect of the invention.

In an illustrative embodiment shown in FIG. 8, the snowboard binding 60 may include a baseplate 62, which is mountable to a snowboard 64, and one or more binding straps, preferably adjustable straps, that are attached to the baseplate for securing a boot (not shown) to the snowboard. The highback 20 is pivotally mounted to the sidewalls of the baseplate 62. A forward lean adjuster 66 may be mounted to the highback to interact with a heel hoop 68 for setting the highback 20 at a preselected forward lean angle relative to the board. A lockdown feature 70, such as a latch, may be provided to lock down the highback 20 to the heel hoop 68 for enhanced toeside response.

As illustrated, the binding 60 may include an ankle strap 72 that extends across the ankle portion of the boot to hold down the rider's heel and a toe strap 74 that extends across and holds down the front portion of the boot. It is to be understood, however, that the binding 60 may employ other strap configurations.

The highback 20 of the present invention, however, is not limited to any particular type of binding. For example, the highback may also be implemented with a step-in snowboard binding that includes a locking mechanism that engages corresponding features provided, either directly or indirectly, on a snowboard boot. The highback may be mounted to a binding baseplate in a manner similar to the binding described above. Examples of step-in snowboard bindings that may incorporate the highback are described in U.S. Pat. No. 5,722,680 and U.S. patent application Ser. No. 08/780,721, which are incorporated herein by reference.

Figure 9:
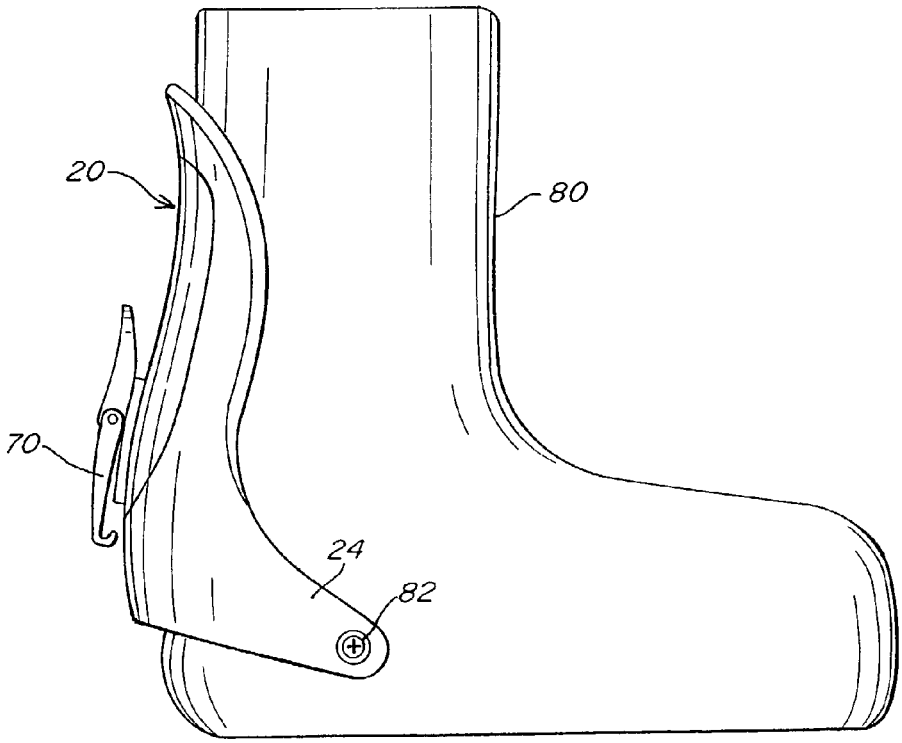
FIG. 9 is a side view of the highback incorporated with an illustrative embodiment of a snowboard boot system according to a further aspect of the invention.

In another embodiment, the highback 20 of the present invention may be either permanently attached to or removable from a snowboard boot. A removable highback provides system flexibility by allowing the boot to be implemented with binding systems that already include a highback mounted to a binding baseplate. As illustrated in FIG. 9, the highback 20 is movably mounted to the heel region of a boot 80. The lateral ears 24 are preferably attached below the ankle portion of the boot for facilitating lateral or side-to-side boot flexibility that allows desirable lateral foot roll. The lateral ears 24 may be attached to the boot, preferably at reinforced attachment points, using any suitable fastener 82, such as a screw, rivet or the like, that passes through each lateral ear.

In another aspect of the invention, the highback 20 may be implemented with a detachable binding interface system for interfacing a boot to a binding. As illustrated in one embodiment shown in FIG. 10, the interface 90 includes a body 92 and at least one adjustable strap 94 that is arranged to be disposed across the ankle portion of the boot 96, which is shown in phantom. The highback 20 is movably mounted to the sidewalls of the interface body 92 using a suitable fastener 95 that passes through the lateral ears 24 of the highback. The body 92 of the interface may include one or more mating features 98, as would be apparent to one of skill in the art, that are adapted to engage corresponding engagement members 100 on the binding 102.

Figure 10:
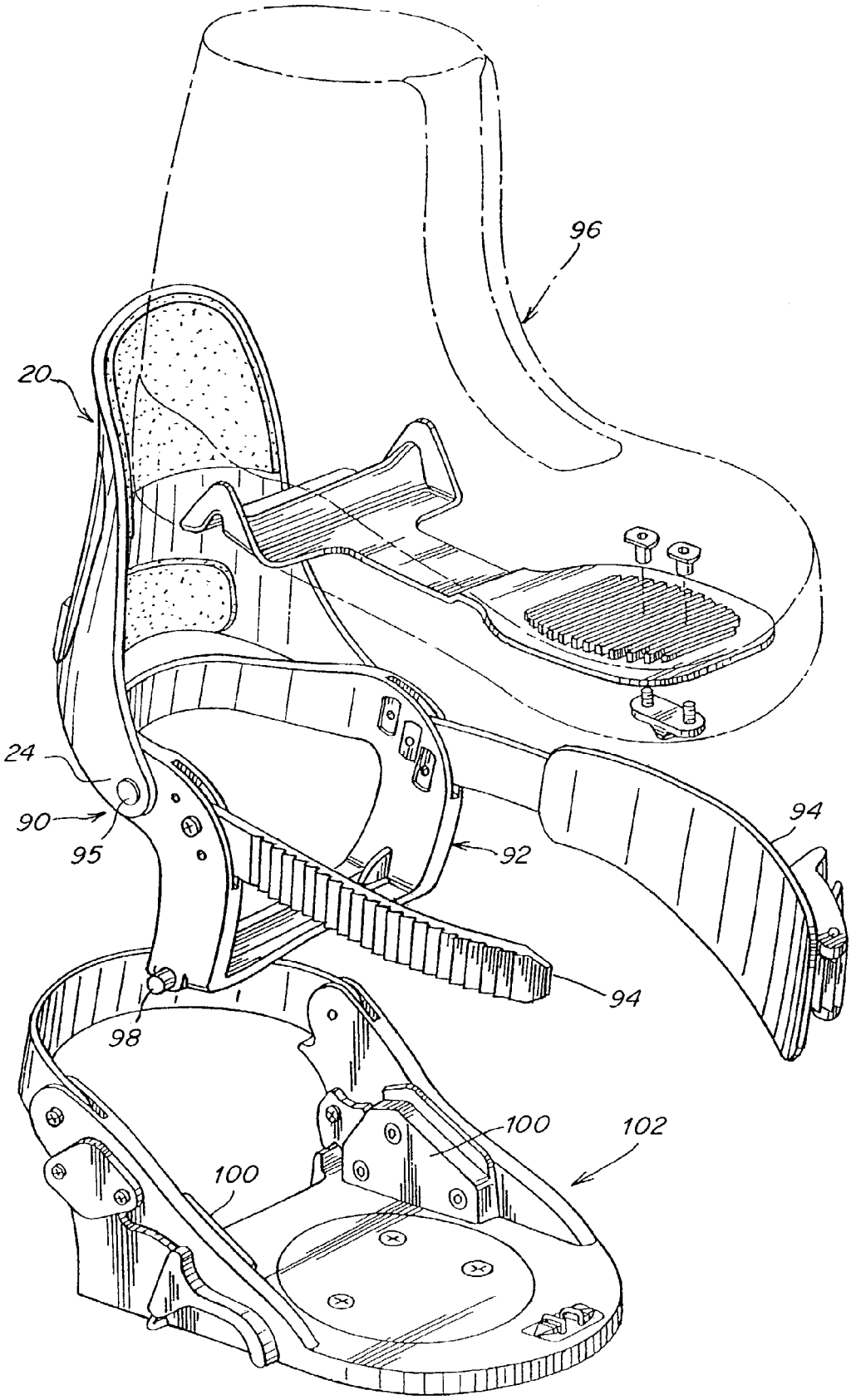
FIG. 10 is a perspective view of the highback incorporated with an illustrative embodiment of a detachable binding interface according to another aspect of the invention.

The particular binding interface 90 and binding 102 shown in FIG. 10 is described in greater detail in a U.S. application Ser. No. 09/062,131, which is incorporated herein by reference.

For ease of understanding, and without limiting the scope of the invention, the inventive highback to which this patent is addressed has been discussed particularly in connection with a boot or binding that is used in conjunction with a snowboard. It should be appreciated, however, that the present invention may be used in association with other types of gliding boards. Thus, for purposes of this patent, "gliding board" refers generally to specially configured boards for gliding along a terrain such as snowboards, snow skis, water skis, wake boards, surf boards and other board-type devices which allow a rider to traverse a surface.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A snowboard binding for securing a snowboard boot to a snowboard, the snowboard binding comprising:

a base that is mountable to the snowboard, the base including a heel hoop disposed at a heel end thereof; and a highback supported at the heel end of the base, the highback comprising;

a lower portion including a heel cup and a pair of mounting locations disposed on opposing sides of the heel cup, the lower portion being mounted to the base at the mounting locations;

an upper portion, supported by the lower portion, adapted to support a rear portion of a rider's leg above the rider's ankle, the upper portion including an upper margin and a pair of side margins extending from the upper margin to the lower portion, the upper portion further comprising a middle region disposed below the upper margin and between the side margins, at least a portion of the middle region being comprised of a first material that has a first stiffness and extends to a mounting region of the upper portion, at least a portion of the upper margin being comprised of a second material, the second material having a second stiffness that is different from the first stiffness, at least a portion of the lower portion that includes the mounting locations being comprised of the second material; and a forward lean adjuster disposed at the mounting region on the upper portion and adapted to engage the heel hoop.

2. The snowboard binding according to claim 1, wherein the lower portion includes a pair of lateral ears supported on the opposing sides of the heel cup, the lateral ears being comprised of the second material, the mounting locations being disposed on the lateral ears.

3. The snowboard binding according to claim 2, wherein the lateral ears are disposed inside the heel hoop.

4. The snowboard binding according to claim 1, wherein the first stiffness is greater than the second stiffness.

5. The snowboard binding according to claim 1, wherein the upper margin is comprised solely of the second material.

6. The snowboard binding according to claim 1, wherein the second material includes a plastic material.

7. The snowboard binding according to claim 1, wherein the first material includes a composite material.

8. The snowboard binding according to claim 7, wherein the composite material includes a carbon reinforcement.

9. The snowboard binding according to claim 1, wherein a portion of the heel cup is formed of the first material.

10. The snowboard binding according to claim 1, wherein the portions of the highback formed from the first material are formed of a first integral component and the portions of the highback formed from the second material are formed from a second integral component.

11. The snowboard binding according to claim 10, wherein the highback further comprises a plurality of fasteners that affix the first integral component to the second integral component.

12. The snowboard binding according to claim 1, wherein the highback further includes at least one resilient pad disposed on an inner surface thereof.

13. The snowboard binding according to claim 1, wherein the base comprises a baseplate, and wherein the binding is constructed and arranged to enable the high-back to be mounted to the binding in at least two positions having different rotational orientations about an axis that is substantially normal to the baseplate.

14. The snowboard binding according to claim 1, further comprising at least one adjustable strap mounted to the base to secure the snowboard boot to the binding.

15. A snowboard binding for securing a snowboard boot to a snowboard, the snowboard binding comprising:

a base that is mountable to the snowboard, the base including a heel hoop disposed at a heel end thereof; and a highback pivotally supported at the heel end of the base, the highback comprising;

a lower portion including a heel cup and a pair of mounting locations disposed on opposing sides of the heel cup, the lower portion being mounted to the base at the mounting locations;

an upper portion, supported by the lower portion, adapted to support a rear portion of a rider's leg above the rider's ankle, the upper portion including an upper margin and a pair of opposing side margins extending from the upper margin to the lower portion, the upper portion further including a middle region disposed below the upper margin and between the side margins, at least a portion of the middle region being comprised of a first material having a first stiffness, the side margins being comprised of a second material that is different from the first material and has a second stiffness that is less than the first stiffness; and a forward lean adjuster provided on the upper portion to engage the heel hoop, wherein the forward lean adjuster is provided at a mounting region disposed below the middle region of the upper portion, the first material extending to at least the mounting region.

16. The snowboard binding according to claim 15, wherein the lower portion includes a pair of lateral ears supported on the opposing sides of the heel cup, the lateral ears being comprised of the second material, the mounting locations being disposed on the lateral ears.

17. The snowboard binding according to claim 16, wherein the lateral ears are disposed inside the heel hoop.

18. The snowboard binding according to claim 15, wherein the upper margin is comprised of the second material.

19. The snowboard binding according to claim 15, wherein at least a portion of the heel cup is comprised of the second material.

20. The snowboard binding according to claim 15, wherein the second material includes a plastic material.

21. The snowboard binding according to claim 15, wherein the first material includes a composite material.

22. The snowboard binding according to claim 21, wherein the composite material includes a carbon reinforcement.

23. The snowboard binding according to claim 15, wherein a portion of the heel cup is formed of the first material.

24. The snowboard binding according to claim 15, wherein the portions of the highback formed from the first material are formed of a first integral component and the portions of the highback formed from the second material are formed from a second integral component.

25. The snowboard binding according to claim 24, wherein the highback further comprises a plurality of fasteners that affix the first integral component to the second integral component.

26. The snowboard binding according to claim 15, wherein the highback further includes at least one resilient pad disposed on an inner surface thereof.

27. The snowboard binding according to claim 15, wherein the base comprises a baseplate, and wherein the binding is constructed and arranged to enable the high-back to be mounted to the binding in at least two positions having different rotational orientations about an axis that is substantially normal to the baseplate.

28. The snowboard binding according to claim 15, further comprising at least one adjustable strap mounted to the base to secure the snowboard boot to the binding.

29. A snowboard binding for securing a snowboard boot to a snowboard, the snowboard binding comprising:

a base that is mountable to the snowboard, the base including a heel hoop disposed at a heel end thereof; and a highback supported at the heel end of the base, the highback comprising;

a lower portion including a heel cup and a pair of mounting locations disposed on opposing sides of the heel cup, the lower portion being mounted to the base at the mounting locations;

an upper portion, supported by the lower portion, adapted to support a rear portion of a rider's leg above the rider's ankle, the upper portion including an upper margin and a pair of opposing side margins extending from the upper margin to the lower portion, the upper portion further including a middle region disposed below the upper margin and between the side margins, at least a portion of the middle region being comprised of a first material having a first stiffness, the upper margin being comprised of a second material that is different from the first material and has a second stiffness that is less than the first stiffness; and a forward lean adjuster provided on the upper portion to engage the heel hoop, wherein the forward lean adjuster is provided at a mounting region disposed below the middle region of the upper portion, the first material extending to at least the mounting region.

30. The snowboard binding according to claim 29, wherein the lower portion includes a pair of lateral ears supported on the opposing sides of the heel cup, the lateral ears being comprised of the second material, the mounting locations being disposed on the lateral ears.

31. The snowboard binding according to claim 30, wherein the lateral ears are disposed inside the heel hoop.

32. The snowboard binding according to claim 29, wherein the side margins are comprised of the second material.

33. The snowboard binding according to claim 29, wherein at least a portion of the heel cup is comprised of the second material.

34. The snowboard binding according to claim 29, wherein the second material includes a plastic material.

35. The snowboard binding according to claim 29, wherein the first material includes a composite material.

36. The snowboard binding according to claim 35, wherein the composite material includes a carbon reinforcement.

37. The snowboard binding according to claim 29, wherein a portion of the heel cup is formed of the first material.

38. The snowboard binding according to claim 29, wherein the portions of the highback formed from the first material are formed of a first integral component and the portions of the highback formed from the second material are formed from a second integral component.

39. The snowboard binding according to claim 38, wherein the highback further comprises a plurality of fasteners that affix the first integral component to the second integral component.

40. The snowboard binding according to claim 29, wherein the highback further includes at least one resilient pad disposed on an inner surface thereof.

41. The snowboard binding according to claim 29, wherein the base comprises a baseplate, and wherein the binding is constructed and arranged to enable the high-back to be mounted to the binding in at least two positions having different rotational orientations about an axis that is substantially normal to the baseplate.

42. The snowboard binding according to claim 29, further comprising at least one adjustable strap mounted to the base to secure the snowboard boot to the binding.

43. A snowboard binding for securing a snowboard boot to a snowboard, the snowboard binding comprising:

a base that is mountable to the snowboard, the base including a heel hoop disposed at a heel end thereof; and a multi-component highback that is supported at the heel end of the base and includes an upper portion and a heel cup, the highback comprising;

a support member that is formed of a first material and includes upper, lower and side margins that define contours of the upper portion of the highback and the heel cup, the support member having at least two mounting locations, disposed on opposing sides of the heel cup, at which the highback is mounted to the base; and a stiffener, formed of a second material that is stiffer than the first material, which is affixed to the support member and creates stiffened regions of the highback, wherein the stiffener extends to at least a mounting region of the upper portion for a forward lean adjuster.

44. The snowboard binding of claim 43, wherein the first material is a plastic material and the second material is a carbon reinforced composite material.

45. The snowboard binding of claim 43, wherein the stiffener extends only partially over the upper portion of the highback so that the upper portion includes regions of varying stiffness.

46. The snowboard binding of claim 45, wherein the highback has medial and lateral sides corresponding to medial and lateral sides of the snowboard boot, and wherein the stiffener stiffens the lateral side of the highback to at least as great an extent as the stiffener stiffens the medial side of the highback.

47. The snowboard binding of claim 45, further comprising a plurality of fasteners that affix the stiffener to the support member.

48. The snowboard binding of claim 43, wherein the mounting locations are disposed inside the heel hoop.

49. A snowboard binding for securing a snowboard boot to a snowboard, the snowboard binding comprising:

a base that is mountable to the snowboard, the base including a heel hoop disposed at a heel end thereof; and a multi-component highback supported at the heel end of the base, the highback comprising;

an upper portion adapted to support a rear portion of a rider's leg above the rider's ankle; and a lower portion, disposed below the upper portion, including a heel cup and at least two mounting locations, disposed on opposing sides of the heel cup, at which the highback is mounted to the base;

wherein the upper portion comprises a support member and a stiffener affixed to the support member, the support member extending to an upper margin of the upper portion of the highback and being formed of a first material, the stiffener being formed of a second material that is stiffer than the first material, wherein the stiffener extends to at least a mounting region of the upper portion for a forward lean adjuster.

50. The snowboard binding of claim 49, wherein the first material is a plastic material and the second material is a carbon reinforced composite material.

51. The snowboard binding of claim 49, wherein the stiffener extends only partially over the upper portion of the highback so that the upper portion includes regions of varying stiffness.

52. The snowboard binding of claim 51, wherein the highback has medial and lateral sides corresponding to medial and lateral sides of the snowboard boot, and wherein the stiffener stiffens the lateral side of the highback to at least as great an extent as the stiffener stiffens the medial side of the highback.

53. The snowboard binding of claim 49, further comprising a plurality of fasteners that affix the stiffener to the support member.

54. The snowboard binding of claim 49, wherein the mounting locations are disposed inside the heel hoop.

55. A snowboard binding for securing a snowboard boot to a snowboard, the snowboard binding comprising:

a base that is mountable to the snowboard, the base including a heel hoop disposed at a heel end thereof; and a multi-component highback that is pivotally supported at the heel end of the base and includes an upper portion, a heel cup and a pair of mounting locations that are disposed on opposing sides of the heel cup and at which the highback is mounted to the base, the highback comprising;

a support member that is formed of a plastic material and includes a first region that defines a contour of the upper portion of the highback and a second region that defines the heel cup, the first region of the support member having upper and side margins;

a stiffener, formed of a carbon reinforced composite material that is stiffer than the plastic material, that is affixed to the first region of the support member, the stiffener extending over some of the first region of the support member and being spaced from the upper and side margins so that the upper portion of the highback includes areas of different stiffness;

a plurality of fasteners that affix the stiffener to the first region of the support member; and a forward lean adjuster disposed on the first region of the support member and adapted to engage the heel hoop, wherein the forward lean adjuster is disposed at a mounting region of the upper portion, the stiffener extending to at least the mounting region.

56. A snowboard binding for securing a snowboard boot to a snowboard, the snowboard binding comprising:

a base that is mountable to the snowboard, the base including a heel hoop disposed at a heel end thereof; and a multi-component highback that is pivotally supported at the heel end of the base and includes an upper portion, a heel cup and a pair of mounting locations that are disposed on opposing sides of the heel cup and at which the highback is mounted to the base, the highback comprising:

a support member that is formed of a plastic material and includes a first region that defines a contour of the upper portion of the highback and a second region that defines the heel cup, the first region of the support member having upper and side margins;

a stiffener, formed of a carbon reinforced composite material that is stiffer than the plastic material, that is affixed to the first region of the support member, the stiffener extending over some of the first region of the support member but less than the entire first region of the support member so that the upper portion of the highback includes areas of different stiffness;

a plurality of fasteners that affix the stiffener to the first region of the support member; and a forward lean adjuster disposed on the upper portion and adapted to engage the heel hoop, wherein the forward lean adjuster is disposed at a mounting region of the upper portion, the stiffener extending to at least the mounting region.

* * * * *